US005697319A

United States Patent [19]

Steensland et al.

[11] Patent Number: 5,697,319

[45] Date of Patent: Dec. 16, 1997

[54] BOAT HULL HAVING THE CAPABILITY OF INSTALLING AN OPTIONAL TRANSDUCER

[75] Inventors: David B. Steensland; Kevin Scott Covell, both of Tulsa, Okla.

[73] Assignee: Lowrance Electronics, Inc., Tulsa, Okla.

[21] Appl. No.: 662,823

[22] Filed: Jun. 12, 1996

[51] Int. Cl.[6] ..... B63B 5/24

[52] U.S. Cl. ..... 114/357; 114/343; 264/278

[58] Field of Search ..... 114/343, 355, 114/357, 359, 270; 264/278

[56] References Cited

U.S. PATENT DOCUMENTS

| | | | |
|---|---|---|---|
| 1,290,448 | 1/1919 | Whiteley, Jr. . | |
| 1,866,643 | 7/1932 | Greear . | |
| 1,994,236 | 3/1935 | Laer . | |
| 3,067,714 | 12/1962 | Allmand . | |
| 3,207,466 | 9/1965 | Vance . | |
| 3,400,683 | 9/1968 | Forest . | |
| 3,797,442 | 3/1974 | McRae . | |
| 3,956,785 | 5/1976 | Halfon . | |
| 4,019,454 | 4/1977 | Landwerlen . | |
| 4,106,745 | 8/1978 | Carrow . | |
| 4,534,307 | 8/1985 | Overs . | |
| 4,938,165 | 7/1990 | Williams et al. | 114/343 |
| 4,953,494 | 9/1990 | McClendon, Jr. | 114/357 |
| 5,260,912 | 11/1993 | Latham . | |
| 5,369,868 | 12/1994 | Ohaus . | |

*Primary Examiner*—Jesus D. Sotelo

*Attorney, Agent, or Firm*—The Bell Seltzer Intellectual Property Group of Alston & Bird LLP

[57] ABSTRACT

A removable form is positioned within a boat hull and may be removed to optionally install a sonar transducer and a method of optionally positioning a sonar transducer within a boat hull after the hull is fabricated. The removable form is defined by a distal end and an opposing proximal end. The proximal end includes a retaining flange extending beyond a nominal thickness of a portion of the hull for anchoring the removable form within the boat hull. The distal end is substantially flush with the outer surface of the hull. The removable form is temporarily adhered to a boat mold and the hull is formed therearound. When the hull is hardened, it is removed from the mold with the removable form secured therein. The hull is operative in this condition, or the removable form may be removed and a sonar transducer may be positioned in its place.

18 Claims, 2 Drawing Sheets

BOAT HULL HAVING THE CAPABILITY OF INSTALLING AN OPTIONAL TRANSDUCER

FIELD OF THE INVENTION

The present invention is directed to a selectively removable form, a boat incorporating the removable form and a method of selectively positioning and removing the removable form from the boat. More specifically, the removable form of the present invention is formed within the boat hull to allow a sonar transducer to be optionally installed within the boat hull after the hull has been fabricated.

BACKGROUND OF THE INVENTION

Sonar technology has many applications related to boating and fishing so as to provide information related to the aquatic environment. Sonar devices are commonly permanently mounted to the hull of a boat to acquire information about the marine environment and to present the acquired information to the operator or others on the boat, particularly to the anglers aboard. For instance, sonar devices acquire and display information such as the depth of the water, the position of underwater obstacles, the location of fish, etc.

Sonar devices include a sonar transducer which transmits ultrasonic signals which travel outward from the transducer, such as in a downward direction, until striking the bottom of the body of water, a fish or other obstacles in the body of water. Upon striking the bottom of the body of water, a fish, or another obstacle, the ultrasonic signals are reflected, thereby creating echo signals which are received by the transducer. The sonar device can then convert the echo signals to electronic signals indicative of the contour of the bottom of the body of water as well as the relative location of other obstacles or fish within the water. The sonar device can then, typically, display a visual representation of these electronic signals, such as on a visual display positioned on the boat.

Prior to the instant invention, sonar transducers have been permanently mounted to the hull of boats. That is, they are integrally formed with the hull of the boat and are not removable, at least without substantially effecting the integrity and operativeness of the boat hull. U.S. Pat. No. 4,938,165 to Williams et al. is illustrative of this practice. According to Williams et al., a plug is either permanently or removably mounted to a boat mold. The boat hull is then formed by spraying or otherwise applying the layers of material, such as a fiberglass reinforced resin, to the mold around the plug. Once the materials have hardened and cured, the hull is removed from the mold and the plug remains on the mold. Thus, the portion of the hull in which the plug was disposed now defines a cavity therein. A sonar transducer having a threaded shank is then inserted into the cavity and secured by a threaded nut. The area surrounding the transducer is then sealed to prevent leakage.

While this method is, indeed, an effective manner of permanently mounting a transducer to the hull of a boat, it does not provide the often desired flexibility of providing a boat which may optionally include a transducer in the hull. That is, a formed hull according to this conventional process must include a transducer which is permanently mounted within and which fills the cavity defined by the plug, thereby rendering the resulting boat more expensive than a boat which does not include a mounted transducer. For instance, if the transducer of the boat according to Williams et al. is removed, the hull would have an opening therein and would be inoperable for its intended purpose. Further, for conventional boats which are not manufactured as outlined by Williams et al. and which do not include a premounted transducer, it is difficult, if not impossible, to properly mount a transducer at some point in time after the hull has been formed, while maintaining a watertight hull.

In addition, when conventional hull mounted transducers are installed into the hull of a boat following the fabrication of the hull, the result can be less than desirable. For example, these transducers are generally mushroom-shaped and extend a distance beyond the outer surface of the hull. As a result, the sonar transducer assumes excess load, such as when the boat is in operation or is placed on a trailer. Further, the outwardly extending transducer may impact against an underwater obstacle during operations of the boat, thereby damaging the transducer, including the transducer crystal. The outwardly extending transducer may also adversely effect water flow characteristics of the hull. Finally, cut fiberglass created during the installation of these transducers can result in rough edges, such that it is difficult to maintain if not impossible, a water tight seal around the transducer.

Accordingly, for a transducer to be mounted according to the method proposed by Williams, et al., the end user must know at the time of purchase or order for purchase whether or not a sonar transducer will ever be desired and request that one be permanently mounted. If unsure, the end user may choose to purchase a hull with a permanently mounted transducer and may never use the boat's sonar capabilities even though the end user has likely purchased a more expensive boat. Alternatively, the end user may purchase a boat without a sonar transducer and may decide, too late, that sonar capabilities are desired, thereby forcing the end user to install a transducer to the previously manufactured hull, such as described above in conjunction with the disadvantages, such as extending outwardly from the hull.

SUMMARY OF THE INVENTION

It is therefore an object of the present invention to provide a boat having the capability of optionally installing a hull-mounted sonar transducer.

It is another object of the present invention to provide a method of forming a boat with an optionally mounted sonar transducer.

It is yet another object of the present invention to provide a removable form which may be installed within the boat hull and which is readily removable to permit sonar transducer installation.

The present invention overcomes the shortcomings and solves the problems of the prior art by providing a hull and the method of forming a hull which is operative without a transducer, but which has the capability to selectively allow a sonar transducer to be mounted within the hull at any time, even after the boat has been purchased. These advantageous results are achieved by providing a removable form which is securely positioned within the hull when the hull is formed. The boat is completely operable and watertight with the removable form mounted within the hull, even if no transducer is ever positioned in the hull. At any point in time after the hull is formed, however, the removable form may be removed and a sonar transducer may be located in its place in a watertight manner and without impairing the operation of the boat.

The removable form for selectively positioning the transducer has an exterior shape which substantially corresponds with the exterior shape of the transducer. The removable form has a length that is at least greater than a nominal thickness of at least a portion of the hull and is positioned within the hull of the boat at a predetermined location. The bottom, or distal, end of the removable form is positioned substantially flush with the bottom or outer surface of the hull. To securely retain the removable form within the hull, a retaining flange is provided and is positioned adjacent an upper, or proximal, end of the removable form so as to engage at least a portion of the thickness of the hull. Accordingly, at least a portion of the upper end of the removable form extends a distance beyond the inner surface of a portion of the hull. In one embodiment, an additional or sealing layer of the hull is formed over the removable form to create an inwardly extending bulge in the hull at the location of the removable form. Thus, the retaining flange may be accessed and removed, such as by a machine tool, to remove the removable form from the hull in order to install a transducer in its place. For example, the bulge as well as the retaining flange and upper portions of the removable form can be removed, such as by grinding, since those portions extend inwardly beyond the inner surface of most portions of the hull. The watertight seal around the transducer is enhanced due to the corresponding configuration of the cavity in the hull when the removable form is withdrawn. Indeed, the boat may be purchased and used with the removable form and, yet, the boat has the versatility of adding sonar capabilities to the boat at any point in time.

BRIEF DESCRIPTION OF THE DRAWINGS

The foregoing and other objects and advantages of the present invention will be made apparent from the following detailed description of the preferred embodiment of the invention and from the drawings, in which.

DETAILED DESCRIPTION OF THE PREFERRED EMBODIMENTS

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art. Like numbers refer to like elements throughout.

Figure 1:
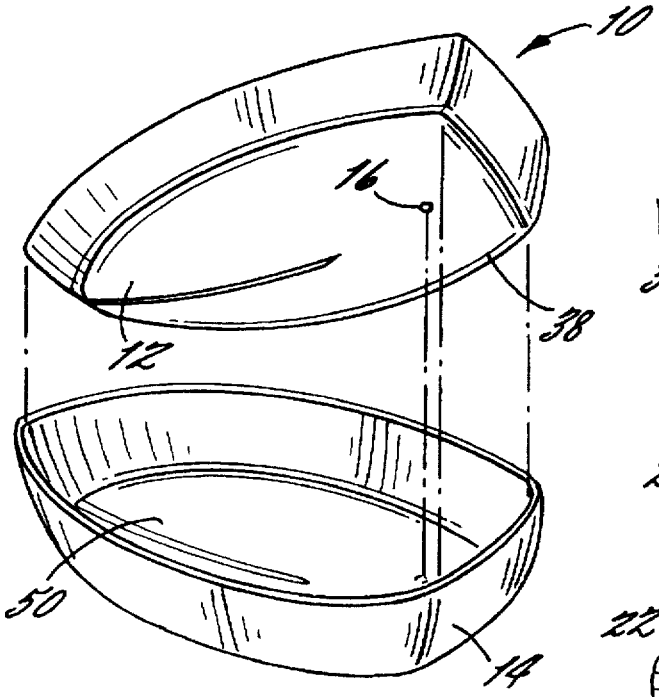
FIG. 1 is an exploded, perspective view of a boat hull formed within a mold.

A boat 10 having the capability for optional installation of a device, such as a sonar transducer, is shown in the various figures. The boat 10 according to the present invention is fully operable and seaworthy with or without a device, such as a transducer, mounted within its hull 12. As best shown in FIG. 1, the hull 12 of the boat 10 is formed within a mold 14 which defines the resulting shape of the boat as is known within the relevant art. A predetermined location 16 is defined within the mold which corresponds to the desired position of the device if, and when, one is installed within the hull 12 of the boat 10. As shown, the device to be optionally installed is a sonar transducer, but it is within the scope of the instant invention to optionally install any hull-mounted devices such as, for example, for temperature or speed detecting devices. The mold 14 is pre-formed so as to conform with the desired hull configuration. The mold 14 is cleaned, polished, and waxed prior to use to provide a release layer and to ensure proper hull formation. A removable form 20 (discussed in more detail below) is temporarily adhered to the mold 14 to secure it in its proper position during formation of the hull 12.

According to the present invention, the boat hull 12 may be formed according to any known method. Commonly, boat hulls are formed of a combination of layers including one or more layers of a synthetic resin, shown generally at 18, which are often reinforced by fibers. Boat hulls also generally include finely spun glass fibers which are woven to make a resulting cloth layer. These two types of layers 18 are placed in the mold 14 in any combination, i.e., alternating layers or random layers or multiple layers of the same type, and then hardened.

A gel coat (not shown) is first applied to provide a smooth, continuous exterior surface of the hull. Next, layers 18 of synthetic resin, either with or without fibers, are sprayed, painted or laid into the mold 14. Any synthetic resin may be employed, with polyester resins providing excellent results. In addition, the reinforcing fibers can be formed of a variety of materials with glass fibers, such as fiberglass fibers, serving as excellent reinforcing fibers. The synthetic resin and glass fibers are typically mixed prior to application so that the glass fibers are embedded in the resin on the mold in a random fashion. Next, a layer of spun glass fiber reinforced cloth may be applied in the mold. Preferably, a slit or such (not shown) is provided in the cloth at the location of the removable form 20 so that the cloth conforms therearound. Alternating layers 18 of sprayed or painted resin and reinforced cloth may be applied until the desired thickness is achieved. Of course, it is within the spirit and scope of the present invention that a layer or layers 18 of only reinforced resin or only reinforced cloth may be used, without alternating the two types of layers. A finishing coat (not shown) is next applied to provide a smooth inner surface of the hull. Once cured or hardened, the formed hull 12 is removed from the mold 14, with the removable form 20 secured therein.

The removable form 20, as shown particularly in FIG. 1, is positioned at the predetermined location 16 when the hull 12 is formed within the mold 14. To ensure that the removable form 20 remains at the predetermined location 16 during the formation of the hull 12, a double sided adhesive 22 is provided so that the removable form 20 will adhere temporarily to the inner surface 24 of the mold 14. The double sided adhesive 22 should have a minimal thickness so as not to interfere with the formation of a smooth, continuous outer surface 38 of the hull 12. As shown, the thickness of the adhesive layer 22 is exaggerated for illustration purposes. The temporary adhesive 22 will provide sufficient adhesion for the removable form 20 to maintain it in its proper position at the predetermined location 16 as the various layers 18, such as a synthetic resin, are sprayed, painted, or otherwise applied to the mold 14 for the formation of the hull 12. The adhesive layer 22, however, preferably will not impede removal of the formed hull 12 with the removable form 20 formed therein from the mold 14.

The removable form 20 comprises an exterior shape which substantially corresponds with an exterior shape of a transducer 26 which may optionally be positioned at the predetermined location 16 if and when the removable form 20 is removed therefrom. Accordingly, when the removable form 20 is removed from the hull 12 (as discussed in more detail below), the resulting cavity 28 defined within the hull 12 will be correspondingly configured or shaped to receive the transducer 26 with minimal, if any, clearance between the transducer 26 and the walls of the cavity 28 to ensure a tight seal therebetween.

The removable form 20 includes a cylindrical portion 30 and a frustoconical portion 32. The overall length or height of the removable form 20 is defined between a proximal end 34 and a distal end 36. As shown in the various figures, particularly FIGS. 5–8, the length of the removable form 20 is greater than a nominal thickness T1 of a portion of the hull 12. Thus, since the distal end 36 of the removable form 20 is positioned substantially flush with an outer surface 38 of the hull 12 so as not to effect water flow characteristics of the hull, the proximal portion of the removable form will extend inwardly beyond the inner surface of at least portions of the hull.

The configuration of the removable form 20 is designed to provide a water tight and secure closure for the cavity 28 of the hull 12 in the instance where the boat will be used with the removable form 20 mounted therein and when no sonar transducer 26 is desired. This water tightness is accomplished, in part, by a retaining flange 40 which is positioned adjacent the proximal end 34 of the removable form 20. The retaining flange 40 extends outward, preferably in a radial direction, from the removable form 20 and is arranged so as to engage at least a portion of the boat's hull 12 for retaining the removable form 20 within the hull 12.

Figure 2:
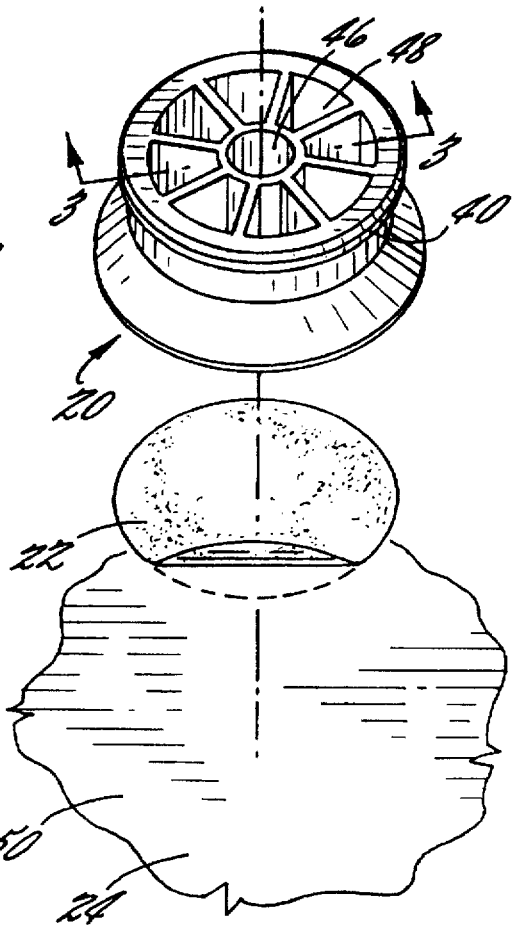
FIG. 2 is a partial, exploded view of a portion of the boat mold with the removable form thereon.
Figure 3:
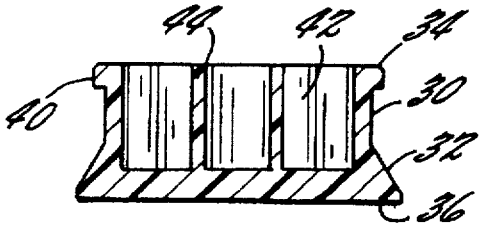
FIG. 3 is a cross-sectional view taken along line 3—3 through the removable form of FIG. 2.
Figure 4:
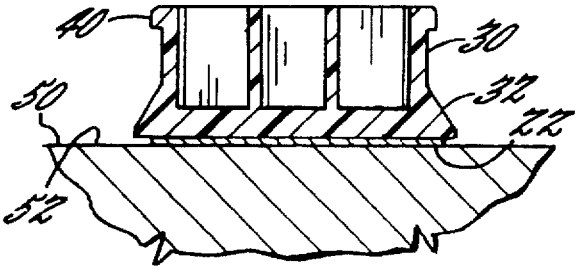
FIG. 4 is a cross-sectional, partial view illustrating a step of the method according to the present invention.

In the preferred embodiment, the removable form 20 is substantially hollow and comprises a plurality of cavities 42 defined by a plurality of cavity walls or ribs 44. This configuration provides structural integrity, particularly because the cavity walls 44 provide lateral support, when the removable form 20 remains within the hull 12 of the boat during operation. Yet, the hollow portions render the removable form relatively light weight and make it easier to remove the retaining flange 40, such as with a machine tool as discussed below. The cavity walls 44 of one embodiment, as shown in FIG. 2, define a central aperture 46 and a plurality of axial displaced apertures 48 at the proximal end 34 of the removable form 20. As shown particularly in FIG. 3, the distal or bottom end 36 of the removable form 20 is continuous so as to provide a continuous, smooth outer surface for the hull 12. The removable form 20 may be formed of any material permitting removal of a portion thereof when a transducer 26 is to be installed into the boat hull 12. In a preferred embodiment, the removable form 20 is formed of a plastic, such as ABS (acrylonitrile-butacliene-styrene) resin, and may be injection molded. Of course, any process may be used to fabricate the removable form.

The method and operation of forming the removable form 20 within the hull 12, and if so desired, its subsequent removal for selectively positioning a transducer 20 in its place, will now be described more fully in detail. As particularly shown in FIGS. 4–10 which illustrate various stages of the formation of the boat hull 12 and the insertion of a transducer 20 therein, the distal end 36 of the removable form 20 is positioned at a predetermined location 16 along the inner surface 50 of the boat mold 14 with a temporary adhesive layer 22 positioned therebetween.

In a preferred embodiment, a plurality of layers of either the reinforced synthetic resin and/or woven spun glass fibers are sprayed, painted, laid, or otherwise applied to the mold 14 as described above. The plurality of layers 18 includes at least a bottommost layer 52 forming the outer surface 38 of the hull and at least one upper layer 54 which may form at least a portion of the inner surface of the hull 12, if desired. In another embodiment, an additional uppermost or sealing layer 56 forming at least a portion of the inner surface 50 of the hull 12 may be applied to the upper layer. Of course, any number of layers or even a single layer of any selected material may be provided without departing from the spirit and scope of the present invention. Also, it is within the scope of the invention that the various layers 18, when cured, may not be discernible, or at least not as discernable as that shown in FIG. 6. With this arrangement, the applied layers 18 form around and over the removable form 20 which, in turn, defines a cavity having a surface configuration substantially corresponding with the exterior surface of the sonar transducer 26. Once the layers 18 have hardened or cured, the formed hull 12 may be removed from the mold 14 in any known fashion. The removable form 20 is anchored within the boat hull 12 due, at least in part, to the retaining flange 40. Accordingly, the removable form 20 is formed integrally with the hull 12 and is removed therewith due to the relatively weak adhesion of the adhesive layer 22 and the secure attachment, at least temporarily, provided by the retaining flange 40.

Figure 5:
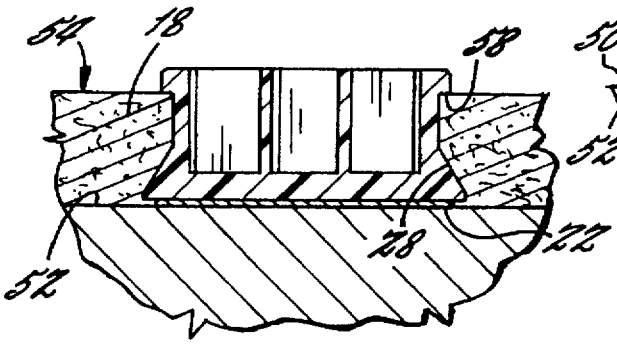
FIGS. 5–10 illustrate cross-sectional, partial views of sequential steps of the method according to the present invention.
Figure 6:
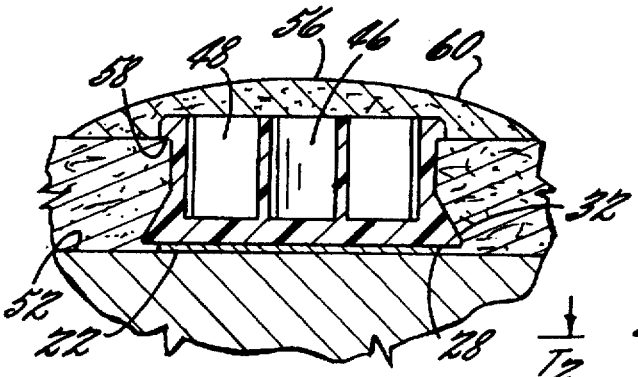

As shown particularly in FIG. 5, the upper layer 54, which may constitute the uppermost layer in one embodiment, is positioned so as to contact the bottom surface 58 of the retaining flange 40 which provides a camming surface therebetween to further support and retain the removable form 20 within the hull 12. A further layer, or sealing layer 56, may then be applied which, as shown in FIG. 6, may completely cover the removable form 20 when viewed from the inner surface 50 of the hull 12. As shown in FIG. 6, when the plurality of layers 18 are applied around and, in one embodiment, over the removable form 20, a bulge or protrusion 60 may form as shown in FIG. 6. As a result, the hull 12 is watertight even in instances in which the removable form 20 remains embedded within the hull 12 in use.

Figure 7:
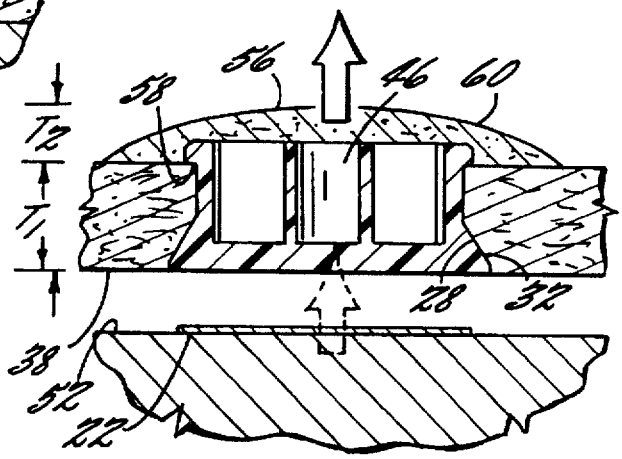
Figure 8:
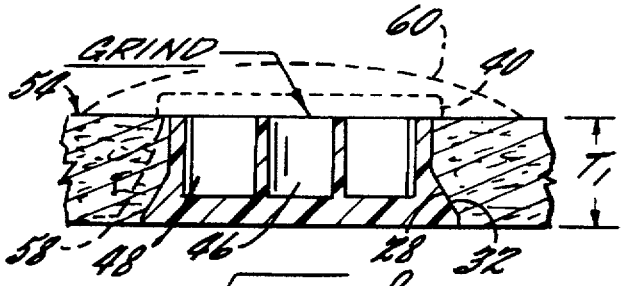

In addition, the portion of the hull in which the removable form is embedded has a second thickness which includes the additional thickness of the bulge 60, as shown in FIG. 7. Preferably, the thickness T1 corresponds to the length or height of the removable form 20 measured from just below the retaining flange 40 to the distal end 36 of the removable form 20. As shown by the arrows in FIG. 7, the hardened and cured hull 12 is then removed from the mold 14 and the temporary adhesive 22 remains with the mold 14 or is removed from the removable form 20. Sealing wax (not shown) may then be applied to the outer surfaces of the hull 12.

At this stage, the hull 12 may be used to produce a boat 10 as the outer surface of the hull 38 constitutes a water tight and continuous surface, particularly since the distal end 36 of the removable form 20 is substantially flush with the outer surface of the hull. If it is desired to remove the removable form 20 so that a transducer 26 may be installed within the hull 12 of the boat 10, the removable form 20 of the present invention may be readily withdrawn. A machine tool (not shown), for example a grinding or a drilling tool, may be used to remove the formed bulge 60 (if one is present), the retaining flange 40 and upper portions of the removable form merely by running the machine tool along the inner surface of the hull and by removing those portions of the hull, i.e. the bulge 60, and the removable form 20 which extend beyond those portions of the inner surface of the hull which are remote from the removable form. In an alternative embodiment where the upper layer 54 constitutes the uppermost layer and the removable is not covered, the same operation can be performed wherein the machine tool will simply remove the retaining flange 40 and upper portions of the removable form. Of course, any means of removing the retaining flange 40 other than a machine tool may be utilized.

Figure 10:
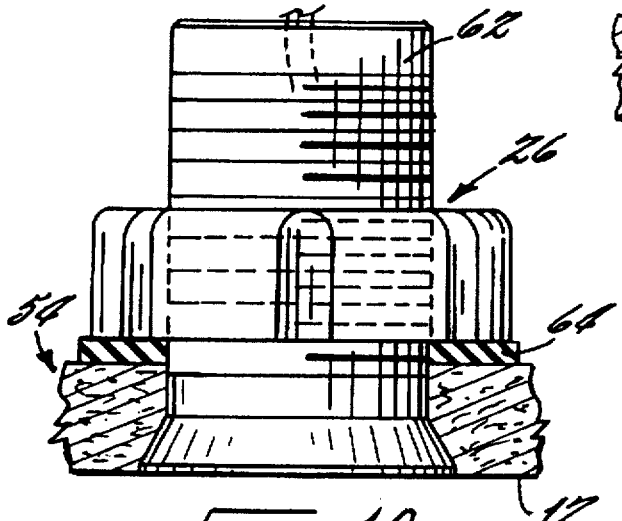
Figure 9:
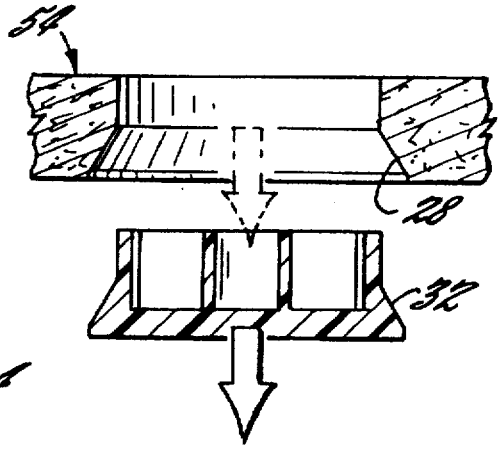

As shown particularly in FIG. 9, the removable form 20 may then be removed from the cavity 28 of the hull 12 as represented by the downwardly extending arrows. At this point, a cavity 28 is defined within the hull 12 such that the boat 10 is not seaworthy. A sonar transducer 26 may then easily be positioned within the cavity 28 as illustrated in FIG. 10 so as to fill the cavity, particularly since the exterior surface of the removed removable form 20 is consistent or is the same as the exterior surface of a portion of the sonar transducer. In the embodiment shown, the sonar transducer 26 includes a threaded collar 62 which is used to secure the transducer 26 against the boat hull 12. A washer 64 may optionally be provided between the threaded collar 62 and the boat hull 12. Once the transducer is installed, the boat 10 now has sonar transducer capabilities and now includes a permanently mounted sonar transducer 20 within its hull 12.

While particular embodiments of the invention have been described, it will be understood, of course, that the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A boat operable with or without a hull-mounted device, the boat comprising:

a hull having an inner surface, an outer surface, and a nominal thickness therebetween;

a removable form having an exterior shape which substantially corresponds with the shape of the hull-mounted device and having a length substantially defined by a proximal end and an opposed distal end, said length is greater than said nominal thickness of at least a portion of said hull, said removable form positioned within said hull of the boat at a predetermined location, said distal end positioned substantially flush with said outer surface of said hull; and a retaining flange positioned adjacent said proximal end of said removable form and extending outward from said removable form and arranged so as to engage at least a portion of said hull at said proximal end of said removable form.

2. The boat according to claim 1 wherein said retaining flange extends inwardly of said inner surface of a portion of said hull to provide access to said retaining flange when said removable form is removed.

3. The boat according to claim 1 wherein said hull is formed of a plurality of layers of said plastic including at least a bottom layer and an upper layer, said retaining flange engaging said upper layer.

4. The boat according to claim 3 wherein said retaining flange is accessible above the upper surface layer of said hull.

5. The boat according to claim 3 further comprising a sealing layer which at least temporarily covers at least a portion of said proximal end of said removable form.

6. The boat according to claim 1 wherein said removable form is substantially annular and substantially defined by a cylindrical portion adjacent said proximal end and a frustoconical portion adjacent said distal end so as to substantially conform to an exterior configuration of the hull-mounted device, said distal end of said frustoconical portion being configured to mount flush with said outer surface of said hull, said retaining flange being positioned along said cylindrical portion.

7. The boat according to claim 1 wherein said hull-mounted device is a sonar transducer.

8. A removable form for positioning a hull-mounted device within the hull of a boat, said form comprising:

a cylindrical portion defining a proximal end surface of said form;

a frustoconical portion defining a distal end surface of said form, wherein the cylindrical portion and the frustoconical portion define at least a portion of an exterior surface of said removable form which is configured to substantially correspond with the shape of said hull-mounted device;

a retaining flange positioned at said proximal end of said removable form to allow optional removal of the retaining flange and extending outwardly therefrom and arranged so as to engage at least a portion of the hull for retaining said removable form in the hull of the boat.

9. The removable form for positioning a hull-mounted device according to claim 8 wherein said frustum is substantially hollow such that said retaining flange is removable therefrom.

10. The removable form for positioning a hull-mounted device according to claim 8 further comprising at least one aperture defined by said proximal end surface of said removable form.

11. The removable form for positioning a hull-mounted device according to claim 8 wherein said distal end surface is substantially continuous.

12. A method of optionally positioning a hull-mounted device within a boat hull wherein the hull at least temporarily includes a removable form which is selectively removed for positioning the hull-mounted device at a predetermined location relative to the hull, the method comprising the steps of:

positioning a removable form at the predetermined location relative to the boat hull, said form having an exterior surface configured to correspond with an exterior surface of the hull-mounted device;

forming a boat hull about the removable form such that a bottom surface of the removable form is positioned substantially flush with a bottom surface of the formed hull;

removing at least an upper portion of the removable form from the hull; and removing remaining portions of the removable form from the hull following removal of the upper portion of the removable form to thereby define a void within the hull which defines a shape which substantially matches the exterior surface of the hull-mounted device.

13. A method according to claim 12 further comprising the step of positioning a transducer in the void defined within the hull at the location the removable form was removed from.

14. A method according to claim 12 wherein said step of removing at least a portion of the removable form is a grinding operation.

15. A method according to claim 12 wherein said step of removing at least a portion of the removable form is a drilling operation.

16. A method according to claim 12 wherein said step of forming the boat hull includes the step of applying a plurality of layers and covering an upper surface of the removable form with at least one layer such that a surface of said upper portion of the removable form is parallel with a portion of an inner surface of the formed hull.

17. A method according to claim 16 wherein said step of removing a portion of the removable form includes removing at least the layer which covers the surface of an upper portion of the removable form.

18. A method according to claim 12 wherein said step of positioning the removable form includes at least temporarily securing the removable form within the hull with a retaining portion adjacent an upper end of the removable form.

* * * * *